US006840207B2

(12) United States Patent
Aiyama et al.

(10) Patent No.: US 6,840,207 B2
(45) Date of Patent: Jan. 11, 2005

(54) RECOIL STARTER FOR BACKPACK-TYPE POWER WORKING MACHINE

(75) Inventors: Fumihiko Aiyama, Tokyo (JP); Fuminori Tezuka, Saitama (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/443,937

(22) Filed: May 22, 2003

(65) Prior Publication Data

US 2003/0217723 A1 Nov. 27, 2003

(30) Foreign Application Priority Data

May 27, 2002 (JP) ..... 2002-152188

(51) Int. Cl.[7] ..... F02N 3/02
(52) U.S. Cl. ..... 123/185.3
(58) Field of Search ..... 123/185.2, 185.3, 123/185.4

(56) References Cited

U.S. PATENT DOCUMENTS 6,508,220 B1 1/2003 Akaike et al. ..... 123/185.14

FOREIGN PATENT DOCUMENTS

JP 11-343949 A * 12/1999 ..... F02N/3/02

* cited by examiner

*Primary Examiner*—Andrew M. Dolinar
(74) *Attorney, Agent, or Firm*—Baker Botts LLP

(57) ABSTRACT

A recoil starter for a backpack-type power working machine which is capable of easily and smoothly performed the starting operation even when the working machine is kept on the operator's back irrespective of differences in the operator's build. This recoil starter comprises a recoil grip which is attached to a distal end portion of a recoil rope extended out of the main body of the recoil starter, wherein the recoil grip is designed such that it can be anchored to a recoil grip-supporting member to be positioned close to an operator's waist and that it can be pulled out in front of the operator from the recoil grip-supporting member. The recoil grip-supporting member is made optionally alterable in position.

16 Claims, 6 Drawing Sheets

RECOIL STARTER FOR BACKPACK-TYPE POWER WORKING MACHINE

BACKGROUND OF THE INVENTION

1. Field of the Invention

The present invention relates to a recoil starter for an internal combustion engine which is adapted to be mounted on a backpack-type power working machine such as a backpack-type power blower, a backpack-type power sprayer, etc.

2. Description of the Related Art

The recoil starter to be employed for starting an internal combustion engine which is adapted to be mounted on a backpack-type power working machine is generally constructed such that it is provided with a recoil handle (recoil rope) so that the internal combustion engine can be started by pulling the recoil grip (which is also called recoil handle) attached to the distal end of the recoil rope against the compression-resisting force of the engine, and that once this recoil grip is released, the recoil rope is automatically wound up to the original state thereof by the effect of recoil-urging means (generally, a spiral spring).

When the recoil rope is kept wound up in the original state thereof, i.e. when the engine-starting operation is not performed, the recoil grip is usually kept stayed at the recoil rope outlet port of the main body of the starter. Therefore, it is impossible for the operator to reach the recoil grip under the condition where the working machine is kept backpacked by the operator's back, i.e. it is impossible for the operator to pull the recoil grip for starting the internal combustion engine under such a condition as mentioned above.

Under the circumstances, as disclosed from JP Utility Model Publication (Kokoku) No.50-11859 (1975), JP Laid-open Utility Model Publication (Kokai) No.57-184264 (1982) and JP Laid-open Utility Model Publication (Kokai) No.58-118259 (1983), in order to enable the operator to perform the starting operation of the engine while the backpack-type working machine is kept shouldered by his back, there has been proposed a recoil starter which is constructed such that the recoil grip (recoil rope) thereof is extended out of the main body of starter (i.e. the recoil rope outlet port) and enabled to be anchored to a recoil grip-supporting member which is designed to be positioned close to an operator's waist portion and that, when the engine is to be started, the recoil grip can be pulled out in front of the operator from the recoil grip-supporting member.

In the case of this conventional recoil starter for a backpack-type power working machine however, since the recoil grip-supporting member thereof is fixedly positioned on one side edge portion of the backpack frame of working machine, it is impossible to optionally alter the location of the recoil grip-supporting member. Therefore, this conventional recoil starter is accompanied with the problem that depending on the operator's build, the recoiling operation (or starting operation of engine) may not be smoothly performed.

BRIEF SUMMARY OF THE INVENTION

The present invention has been made in view of overcoming the aforementioned problems accompanied with the conventional recoil starters, and therefore, it is an object of the present invention to provide a recoil starter for a backpack-type power working machine which is capable of easily and smoothly performed the starting operation even when the working machine is kept shouldered by the operator's back irrespective of differences in the operator's build.

With a view to attaining the aforementioned object, there is provided, in accordance with the present invention, a recoil starter for starting an internal combustion engine to be mounted on a backpack-type power working machine; said recoil starter comprising a recoil grip which is attached to a distal end portion of a recoil rope extending out of the main body of said recoil starter, wherein the recoil grip is designed such that it can be anchored to a recoil grip-supporting member to be positioned close to an operator's waist and that it can be pulled out in front of the operator from the recoil grip-supporting member, said recoil starter being characterized in that the recoil grip-supporting member is made optionally alterable in position.

In a preferred embodiment, the recoil grip-supporting member is made movable horizontally as well as vertically.

In a more specific preferred embodiment, the recoil grip-supporting member is fixedly secured to a lateral position-adjusting bracket, which is enabled to move right and left horizontally from one side edge portion of a backpack frame and adapted to be fastened at an optionally extended position thereof to the backpack frame by making use of a screw member.

In this case, the lateral position-adjusting bracket is preferably fastened, by making use of the screw member, to an elevational position-adjusting bracket which is secured, while being made movable up and down, to one side edge portion of the backpack frame, and the elevational position-adjusting bracket is adapted to be fastened at an optional height to the backpack frame by making use of a screw member.

In another preferred embodiment, an extended portion of the recoil rope which is located between the main body of the starter and the recoil grip-supporting member is loosely inserted in a flexible guide pipe.

In a preferred embodiment of the recoil starter for a backpack-type power working machine, which is constructed as described above according to the present invention, the position of the recoil grip-supporting member can be altered as follows. For example, when the operator is more burly than a person of standard size, the lateral position-adjusting bracket is shifted rightward away from the backpack frame, thereby permitting the lateral position-adjusting bracket to protrude to a suitable extent from one side edge portion of the backpack frame, and under this protruded condition, the lateral position-adjusting bracket is directly or indirectly (i.e. through the elevational position-adjusting bracket) secured and fixed to the backpack frame by making use of a screw.

As a result, the recoil grip-supporting member as well as the recoil grip which is anchored to the recoil grip-supporting member can be positioned at any location which is spaced away rightward by a suitable distance from one side edge portion of the backpack frame, i.e. the location which matches with the build of the operator. As a result, the recoiling operation with a working machine being kept shouldered by the operator's back can be more easily and smoothly performed as compared with the conventional recoil starter where the position of the recoil grip-supporting member is inalterably fixed at a predetermined position.

Further, according to the aforementioned preferable embodiment of the recoil starter of the present invention, the position of the recoil grip-supporting member can be altered not only in the lateral direction but also in the elevational direction. Namely, since the lateral position-adjusting bracket is fixedly fastened to the elevational position-adjusting bracket which is secured, while being made movable in elevational direction, to one side edge portion of the backpack frame, and also, since the elevational position-adjusting bracket is enabled to be fixedly fastened at a desired height to the backpack frame, the position of the recoil grip-supporting member can be optionally altered not only in the lateral direction but also in the elevational direction. Therefore, it is now possible for the operator to fasten the recoil grip at any location which is suited for the operator, so that the recoiling operation can be more easily and smoothly performed by the operator.

DETAILED DESCRIPTION OF THE INVENTION

Next, one embodiment of the recoil starter according to the present invention will be explained with reference to the drawings.

Figure 1:
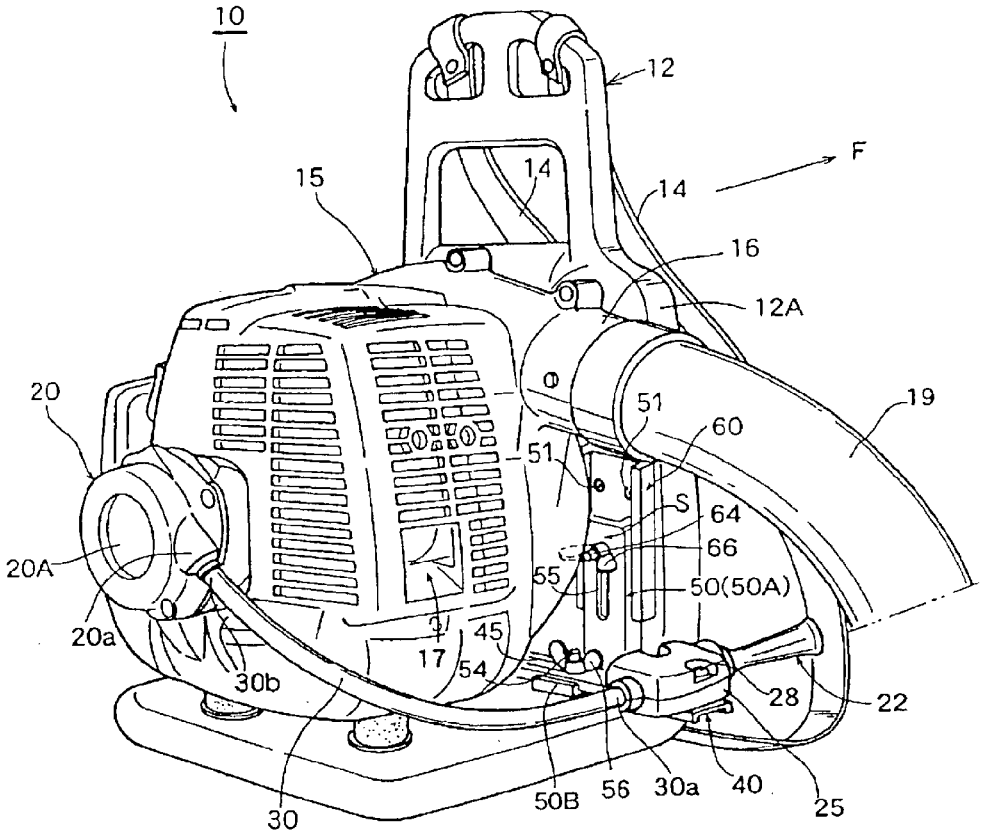
FIG. 1 is a perspective view of a recoil starter representing one embodiment of the present invention, which is shown together with a backpack-type power working machine as they are viewed from the right rear side thereof.

FIG. 1 is a perspective view of a recoil starter representing one embodiment of the present invention, which is shown together with a backpack-type power working machine as they are viewed from the right rear side thereof. The backpack-type power working machine 10 shown in FIG. 1 is called a power blower which is designed to perform the fallen leaves- or refuse-gathering work by making use of the blowing action of accelerated and pressurized air instead of using a broom. This backpack-type power working machine 10 comprises an L-shaped (in side view) backpack frame 12 having a pair of backpack bands 14, and a centrifugal air blower 15 which is fixedly mounted on the backpack frame 12 and directly coupled with an air-cooled two cycle gasoline engine (internal combustion engine) 17 functioning as a driving power source. This air blower 15 is designed to act in such a manner that the external air inhaled by this air blower 15 is accelerated and pressurized and then, ejected from an exhaust port 16 laterally protruding from a right side portion of the air blower 15, the ejected air being thereafter permitted to pass through a bent pipe 19, a bellows-like flexible pipe, a blower pipe (not shown), etc. so as to be finally ejected to external atmosphere. A recoil starter 20 according to this embodiment is linked to an outer end portion (or rear end portion) of the crankshaft (not shown) of the internal combustion engine 17, which is disposed coaxial with the rotation axis (not shown) of the air blower 15.

This recoil starter 20 is of a power-accumulating type and comprises a driving component provided with a rope reel (not shown) around which the recoil rope 21 is wound and which is enabled to rotate as the recoil rope 21 (recoil grip 22) is pulled out, and with a spiral spring (not shown) functioning as recoil-urging means for reversely rotating the rope reel so as to automatically wind up the recoil rope 21. This recoil starter 20 also comprises a driven component to which the rotation of the aforementioned driving component is transmitted, and a spiral spring mechanism functioning as buffering/power-accumulating means, which is disposed between the driving component and the driven component, wherein the buffering/power-accumulating means is enabled, during the driving process by the driving component, to accumulate the power supplied through the driving process by the driving component while alleviating any shock to the driven component, the accumulated power being subsequently utilized to drive the driven component (details of this mechanism are shown in JP Patent gazette No. 3,274,671 (U.S. Pat. No. 6,508,220), the applicant of which is the same with the present applicant).

As clearly shown in FIG. 4, the recoil grip 22 which is attached to one end portion of the recoil rope 21 is configured such that the distal end portion 22*f* as well as the proximal end portion 22*e* of the reversely tapered grip portion 22*a* are both enlarged in diameter, and furthermore, this recoil grip 22 is extended out of the outlet 20*a* of the main body 20A by a predetermined distance and anchored to a recoil grip-supporting member 25 (to be explained hereinafter) which is to be positioned close to an operator's waist when the working machine 10 is placed on the operator's back. When the internal combustion engine 17 is to be started, this recoil grip 22 can be pulled out toward the front F of the operator from the recoil grip-supporting member 25 (see FIG. 2). An extended portion 21A of the recoil rope 21 which is located between the main body 20A and the recoil grip-supporting member 25 is loosely inserted in a flexible guide pipe 30. A fore-end portion 30*a* of the guide pipe 30 is fixed to the recoil grip-supporting member 25, and a rear-end portion 30*b* of the guide pipe 30 is not fixed to the outlet 20*a* but simply disposed to face the outlet 20*a*, thereby alleviating any inconvenience even if the guide pipe 30 is caught in the branches of tree.

In this embodiment, the position of the recoil grip-supporting member 25 is made optionally alterable not only in the lateral (or horizontal) direction but also in elevational (or vertical) direction.

Figure 2:
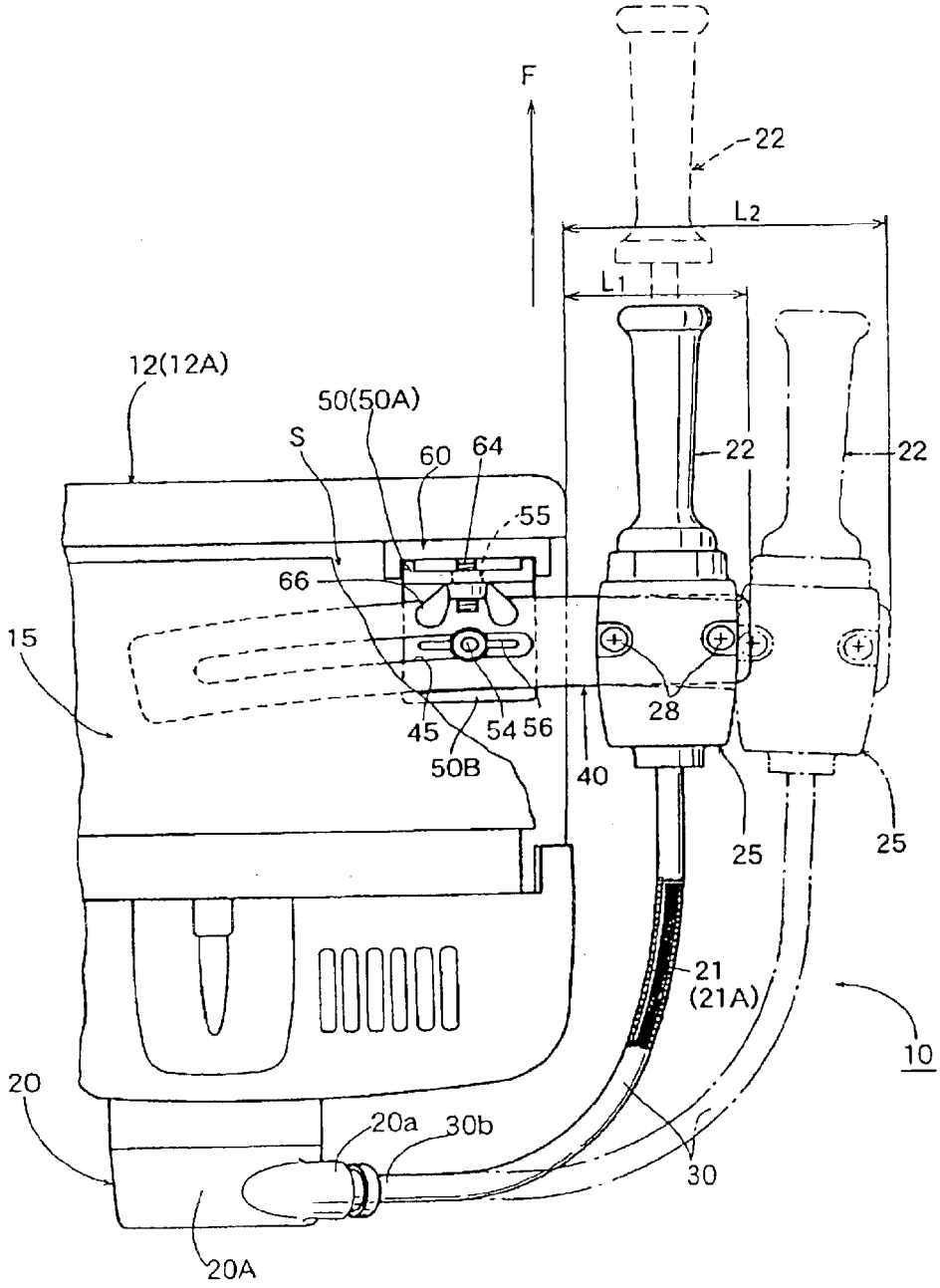
FIG. 2 is a partial sectioned plan view of the recoil starter shown in FIG. 1.
Figure 3:
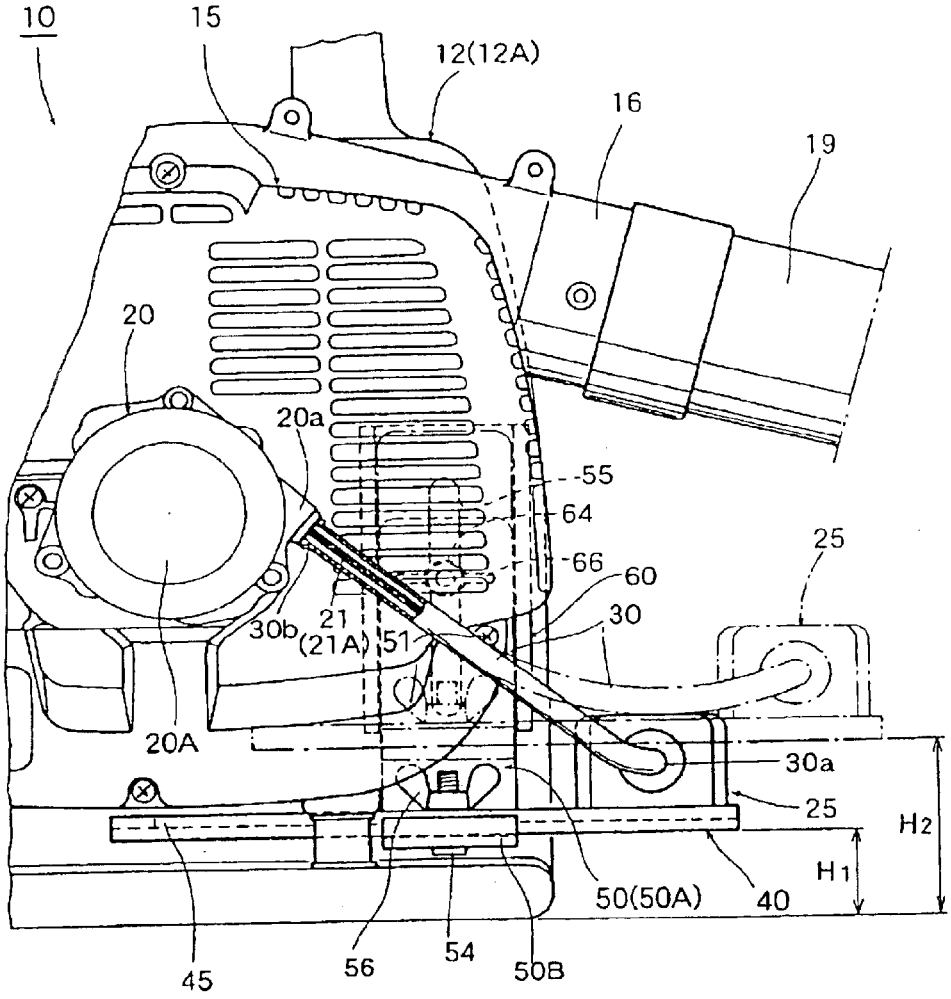
FIG. 3 is a partially sectioned plan view showing the underside of the recoil starter shown in FIG. 1.
Figure 4:
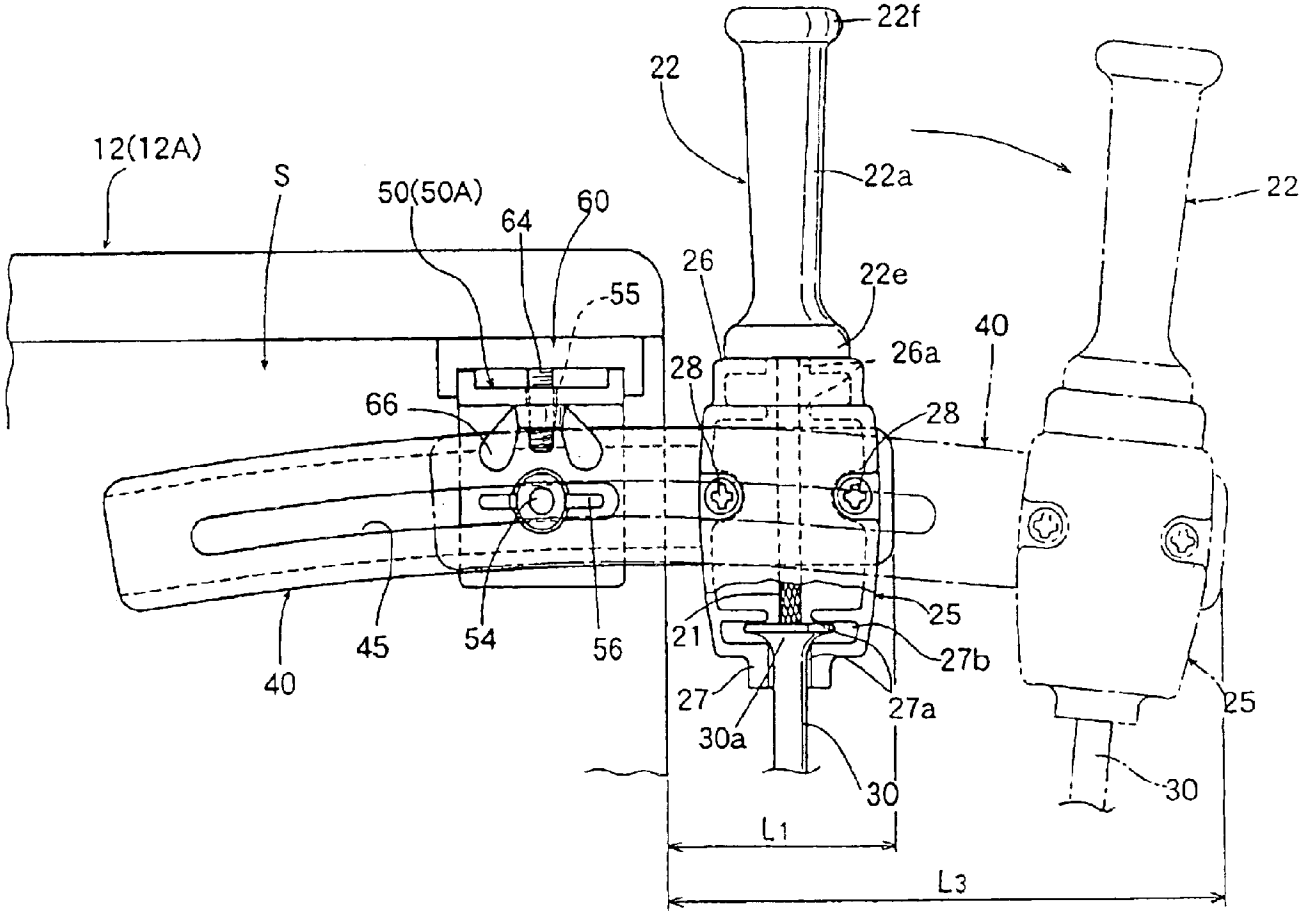
FIG. 4 is a partially sectioned enlarged plan view of the recoil grip-supporting member, including a peripheral portion thereof, of the starter shown in FIG. 1.
Figure 5:
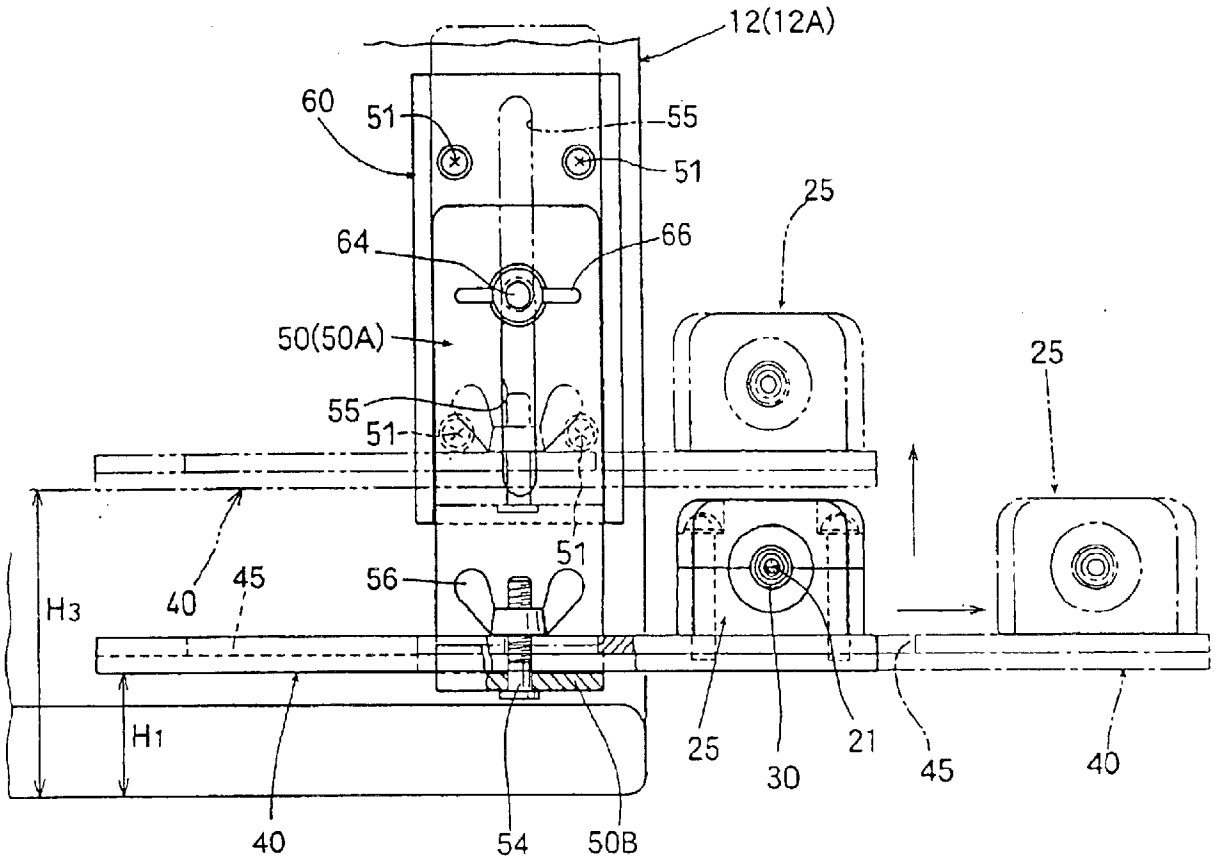
FIG. 5 is a partially sectioned enlarged underside view of the recoil grip-supporting member, including a peripheral portion thereof, of the starter shown in FIG. 1.
Figure 6:
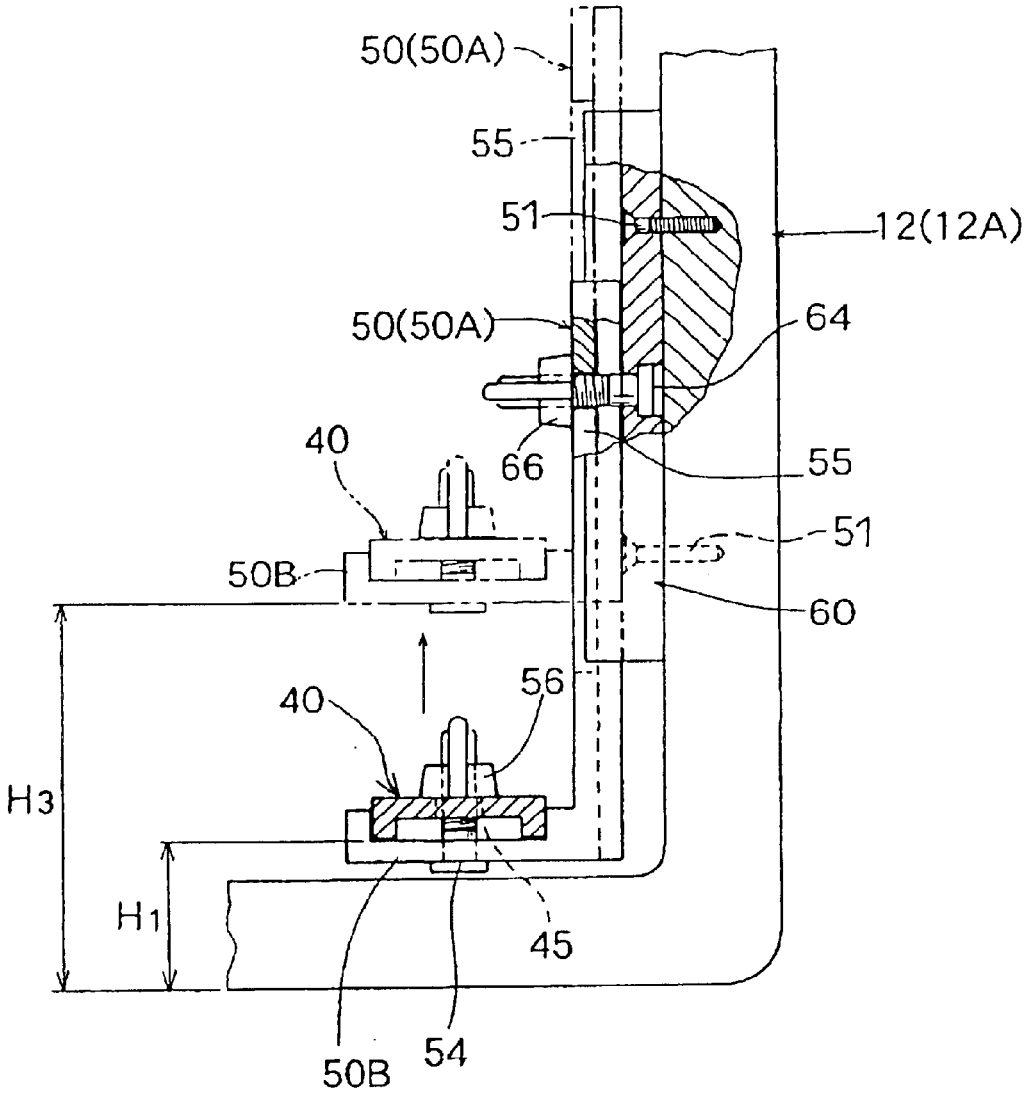
FIG. 6 is a partially sectioned enlarged side view showing the recoil grip-supporting member, including a peripheral portion thereof, of the starter shown in FIG. 1.

More specifically, as clearly seen from FIGS. 4 to 6 in addition to FIGS. 1 to 3, an elevational position-adjusting guide 60 which is U-shaped in cross section is secured, by means of a screw 51, to a right edge portion of the vertical frame portion 12A of the backpack frame 12. To this elevational position-adjusting guide 60 is attached an elevational position-adjusting bracket 50 which is L-shaped in side view in such a manner that the vertical sides 50A of a U-shaped portion of the elevational position-adjusting bracket 50 are snugly fitted in the elevational position-adjusting guide 60, so that the elevational position-adjusting bracket 50 is permitted to slidably move up and down along the length of the elevational position-adjusting guide 60. Additionally, a lateral position-adjusting bracket 40 is snugly and slidably fitted in a U-shaped and horizontally extended bottom plate portion 50B of the elevational position-adjusting bracket 50, so that the lateral position-adjusting bracket 40 is movable in horizontal direction.

A stud bolt 64 is fixedly secured, by means of welding for instance, to a central portion of the elevational position-adjusting guide 60, permitting the stud bolt 64 to protrude rearward therefrom. Further, a vertical slot 55 having a predetermined length and extending in the longitudinal direction of the elevational position-adjusting bracket 50 is formed at an intermediate portion between the vertical sides 50A of the elevational position-adjusting bracket 50, thereby permitting the aforementioned stud bolt 64 to be inserted therein and protruded therefrom. The elevational position of the elevational position-adjusting bracket 50 can be selected in such a manner that the bracket 50 is slidably moved upward or downward along the elevational position-adjusting guide 60 so as to set the bracket 50 to a desired position, and then, through the engagement between the stud bolt 64 and a wing nut 66, the bracket 50 is fixedly secured to the elevational position-adjusting guide 60.

As shown in FIGS. 2 and 4, the lateral position-adjusting bracket 40 is slightly curved as a whole so as to form a circular arc with center at the outlet 20*a*, a middle portion of the circular arc being protruded forward (F). Further, the lateral position-adjusting bracket 40 is provided at the central portion thereof with a horizontal slot 45 having a predetermined length and extending along the longitudinal direction of the lateral position-adjusting bracket 40. Additionally, another stud bolt 54 is fixedly secured, by means of welding for instance, to a central portion of the bottom plate portion 50B of the elevational position-adjusting bracket 50, permitting the stud bolt 54 to be protruded therefrom, thereby enabling the stud bolt 54 to be inserted in and protruded upward from the horizontal slot 45. The lateral position of the lateral position-adjusting bracket 40 (the distance L protruding outward from the right edge of the backpack frame 12) can be selected in such a manner that the bracket 40 is slidably moved in lateral direction along the bottom plate portion 50B of the elevational position-adjusting bracket 50 so as to enable the bracket 40 to be set at a desired position, and then, through the engagement between the stud bolt 54 and a wing nut 56, the bracket 40 is fixedly secured to the bottom plate portion 50B of the elevational position-adjusting bracket 50.

The recoil grip-supporting member 25 is fixedly mounted by means of locking screws 28 on the surface of right edge portion of the lateral position-adjusting bracket 40. This recoil grip-supporting member 25 is formed of a horizontally partitioned two-piece structure, and as shown in FIG. 4, is provided with a couple of insertion bores 26*a* and 27*a* which are formed at a central portion of the fore-end portion 26 and of the rear-end portion 27, respectively, of the recoil grip-supporting member 25. The recoil rope 21 is linked, through these insertion bores 26*a* and 27*a*, with the recoil grip 22. The rear end portion 22*e* of the recoil grip 22 is enabled to engage with the fore-end portion 26 of the recoil grip-supporting member 25. The recoil grip-supporting member 25 is connected with the flexible guide pipe 30 in such a manner that a bell-shaped distal end portion 30*a* of the flexible guide pipe 30 is fitted in a groove 27*b* which is formed in the rear-end portion 27 of the recoil grip-supporting member 25.

The lateral position-adjusting bracket 40 is designed to be inserted in a space S (an air inlet space) located between the vertical frame portion 12A of the backpack frame 12 and the air blower 15 as the lateral position-adjusting bracket 40 is withdrawn leftward (inner side).

In the recoil starter 20 which is constructed as described above according to this embodiment, the position of the recoil grip-supporting member 25 can be altered as follows. For example, when the operator is more burly than a person of standard size, the wing nut 56 for adjusting the lateral position is loosened at first, and then, the lateral position-adjusting bracket 40 is slide-shifted from the initial preset position $L_1$ indicated by a solid line in the drawings toward the position $L_2$ or $L_3$ which are indicated by a dashed line (externally rightward from the backpack frame 12), thereby permitting the lateral position-adjusting bracket 40 to protrude to a suitable extent from right side edge portion of the backpack frame 12, and under this protruded condition, the wing nut 56 is again clamped so as to fixedly secure the lateral position-adjusting bracket 40 to the bottom plate portion 50B of the elevational position-adjusting bracket 50.

As a result, the recoil grip-supporting member 25 as well as the recoil grip 22 which is anchored to the recoil grip-supporting member 25 can be positioned at a location $L_1$, $L_2$ or $L_3$, which is spaced away rightward by a suitable distance from the right side edge portion of the backpack frame 12, i.e. the location which matches with the build of the operator. As a result, the recoiling operation with a working machine 10 being kept shouldered by the operator's back can be more easily and smoothly performed as compared with the conventional recoil starter where the position of the recoil grip-supporting member is inalterably fixed at a predetermined position.

Further, according to the recoil starter 20 of the present embodiment, the position of the recoil grip-supporting member 25 can be altered not only in the lateral direction but also in the elevational direction. Namely, the wing nut 66 for adjusting the elevational position is loosened at first, and then, the elevational position-adjusting bracket 50 is slide-shifted upwardly from the initial preset position H1 indicated by a solid line in the drawings to the position H2 or H3 which are indicated by a two-dot chain line, thereby positioning the elevational position-adjusting bracket 50 at a suitable height, and under this condition, the wing nut 66 is again clamped so as to fixedly secure the elevational position-adjusting bracket 50 to the elevational position-adjusting guide 60.

As described above, according to the recoil starter 20 of the present embodiment, the position of the recoil grip-supporting member 25 can be optionally altered not only in the lateral direction but also in the elevational direction, and at the same time, since the recoil grip 22 is increasingly inclined as it is increasingly pulled away from the backpack frame 12 as shown in FIG. 4, the recoiling operation can be more easily and smoothly performed.

Furthermore, the recoil starter 20 of the present embodiment is advantageous in that it can be constructed by simply attaching simple constituent members including the lateral position-adjusting bracket 40, the elevational position-adjusting bracket 50, the elevational position-adjusting guide 60, the bolts 54 and 64, wing nuts 56 and 66, etc. to an existing conventional backpack-type power working machine 10, and that as described above, the position of the recoil grip-supporting member 25 can be optionally and simply altered.

While in the foregoing, one embodiment of the present invention has been explained, it will be understood that the present invention is not limited to the embodiment, but the construction thereof can be varied without departing from the spirit and scope of the invention.

For example, although a combination of a slot, a stud bolt and a wing nut is employed as position-adjusting means in the embodiment shown in the drawings, it may be substituted by a combination of a locking pin and a plurality of position-adjusting hole which are provided equidistantly, by a clip stop mechanism, or by any other suitable means.

As clearly seen from the above explanations, since the recoil grip-supporting member is enabled to optionally change in position in the recoil starter for a backpack-type power working machine according to the present invention, it is now possible to easily and smoothly perform the starting operation even when the working machine is kept on the operator's back irrespective of differences in the operator's figure.

What is claimed is:

1. A recoil starter arrangement for a backpack-type power working machine for use by an operator, comprising:

a recoil grip-supporting member optionally alterable in position and wherein said recoil grip-supporting member is movable horizontally and vertically;

a recoil grip attached to a distal end portion of a recoil rope extending out of a main body of a recoil starter and anchorable to the recoil grip-supporting member such that the recoil grip is positionable close to an operator's waist and capable of being pulled out in front of the operator from the recoil grip-supporting member; and a lateral position-adjusting bracket enabled to move right and left horizontally from one side edge portion of a backpack frame and adapted to be adjustably fastened at an optionally extended position thereof to said backpack frame, wherein said recoil grip-supporting member is fixedly secured to the lateral position-adjusting bracket.

2. The recoil starter arrangement according to claim 1, further comprising an elevational position-adjusting bracket secured, while being made movable up and down, to one side edge portion of the backpack frame, said elevational position-adjusting bracket adapted to be adjustably fastened at an optional height to the backpack frame, wherein said lateral position-adjusting bracket is adjustably fastened to said elevational position-adjusting bracket.

3. The recoil starter arrangement according to claim 2, further comprising:

a first screw member for adjustably fastening the lateral position-adjusting bracket to the backpack frame and for fastening the lateral position-adjusting bracket to the elevational position-adjusting bracket; and a second screw member for adjustably fastening the elevational position-adjusting bracket to the backpack frame.

4. The recoil starter arrangement according to claim 3, wherein said first screw member comprises a first bolt and a first wing nut and said second screw member comprises a second bolt and a second wing nut.

5. The recoil starter arrangement according to claim 2, further comprising a flexible guide pipe, wherein an extended portion of the recoil rope located between the main body of the recoil starter and the recoil grip-supporting member is loosely insertable in the flexible guide pipe.

6. A recoil starter arrangement for a backpack-type power working machine for use by an operator, comprising:

a recoil grip-supporting member optionally alterable in position; and a recoil grip attached to a distal end portion of a recoil rope extending out of a main body of a recoil starter and anchorable to the recoil grip-supporting member such that the recoil grip is positionable close to an operator's waist and capable of being pulled out in front of the operator from the recoil grip-supporting member; and a lateral position-adjusting bracket enabled to move right and left horizontally from one side edge portion of a backpack frame and adapted to be adjustably fastened at an optionally extended position thereof to said backpack frame, wherein said recoil grip-supporting member is fixedly secured to the lateral position-adjusting bracket.

7. The recoil starter arrangement according to claim 6, further comprising an elevational position-adjusting bracket secured, while being made movable up and down, to one side edge portion of the backpack frame, said elevational position-adjusting bracket adapted to be adjustably fastened at an optional height to the backpack frame, wherein said lateral position-adjusting bracket is adjustably fastened to said elevational position-adjusting bracket.

8. The recoil starter arrangement according to claim 7, further comprising:

a first screw member for adjustably fastening the lateral position-adjusting bracket to the backpack frame and for fastening the lateral position-adjusting bracket to the elevational position-adjusting bracket; and a second screw member for adjustably fastening the elevational position-adjusting bracket to the backpack frame.

9. The recoil starter arrangement according to claim 8, wherein said first screw member comprises a first bolt and a first wing nut and said second screw member comprises a second bolt and a second wing nut.

10. The recoil starter arrangement according to claim 7, further comprising a flexible guide pipe, wherein an extended portion of the recoil rope located between the main body of the recoil starter and the recoil grip-supporting member is loosely insertable in the felxible guide pipe.

11. The recoil starter arrangement according to claim 1, further comprising a flexible guide pipe, wherein an extended portion of the recoil rope located between the main body of the recoil starter and the recoil grip-supporting member is loosely insertable in the flexible guide pipe.

12. The recoil starter arrangement according to claim 3, further comprising a flexible guide pipe, wherein an extended portion of the recoil rope located between the main body of the recoil starter and the recoil grip-supporting member is loosely insertable in the flexible guide pipe.

13. The recoil starter arrangement according to claim 4, further comprising a flexible guide pipe, wherein an extended portion of the recoil rope located between the main body of the recoil starter and the recoil grip-supporting member is loosely insertable in the flexible guide pipe.

14. The recoil starter arrangement according to claim 6, further comprising a flexible guide pipe, wherein an extended portion of the recoil rope located between the main body of the recoil starter and the recoil grip-supporting member is loosely insertable in the flexible guide pipe.

15. The recoil starter arrangement according to claim 8, further comprising a flexible guide pipe, wherein an extended portion of the recoil rope located between the main body of the recoil starter and the recoil grip-supporting member is loosely insertable in the flexible guide pipe.

16. The recoil starter arrangement according to claim 9, further comprising a flexible guide pipe, wherein an extended portion of the recoil rope located between the main body of the recoil starter and the recoil grip-supporting member is loosely insertable in the flexible guide pipe.

* * * * *